United States Patent [19]

Dailey et al.

[11] Patent Number: 4,967,680

[45] Date of Patent: Nov. 6, 1990

[54] VERTICALLY ZIP-REEFING SAIL

[76] Inventors: Kevin S. Dailey; Harold W. Dailey, Jr., both of 65 Summit Drive, Smithtown, N.Y. 11788

[21] Appl. No.: 295,385

[22] Filed: Jan. 10, 1989

[51] Int. Cl.[5] ..... B63H 9/10

[52] U.S. Cl. ..... 114/104; 114/103

[58] Field of Search ..... 114/102, 105, 108, 39.1

[56] References Cited

U.S. PATENT DOCUMENTS

| | | | |
|---|---|---|---|
| 2,247,219 | 6/1941 | Childs | 114/104 |
| 4,343,257 | 8/1982 | Stevenson | 114/104 |
| 4,365,572 | 12/1982 | Stevenson | 114/104 |

FOREIGN PATENT DOCUMENTS

| | | | |
|---|---|---|---|
| 2934937 | 3/1981 | Fed. Rep. of Germany | 114/104 |

*Primary Examiner*—Joseph F. Peters, Jr.
*Assistant Examiner*—Edwin L. Swinehart
*Attorney, Agent, or Firm*—Frishauf, Holtz, Goodman & Woodward

[57] ABSTRACT

A zip-fastener on each side of a working sail, for example a mainsail, makes it possible to remove from the effective area of the sail an elongated triangular area with its apex at the top and one side of it disposed close to the luff. In one embodiment the zip-fastener on one side has one tape close to and parallel to the luff and another tape extending from the head of the sail to a point on the foot spaced from the luff by up to about 40% of the length of the foot of the sail, while on the other side of the zip-fastener, which likewise extends downward from the head of the sail, has a forward tape that runs down to a location at the foot of the sail about mid-way between the fastener tapes at the first mentioned side of the sail and an aft tape which extends to near the foot of the sail at a location spaced aft of the aft tape of the first mentioned fastener, so that the aft tape of the first mentioned fastener is about mid-way between the fastener tapes of the aft fastener. Reefing and unreefing lines for each fastener are provided for moving the fastener slide down and up. In another embodiment both zip-fasteners are placed on opposite sides of the sail with a forward tape stitched to a double-liffed portion of the sail which gets progressively wider from the headboard down to the foot. The two zip-fasteners are in this case equidistant from the mast and the unused part of the narrowed sail goes into a pocket.

5 Claims, 6 Drawing Sheets

VERTICALLY ZIP-REEFING SAIL

This invention relates to sails, particularly working sails of a sailing yacht, more particularly mainsails, although it is applicable to all working sails which can be reefed over their entire height by shortening the foot of the sail rather than by shortening the hoist.

Reefing is a general term referring to reducing the exposed sail area of a sail in order to reduce the heeling moment or other stresses on a sailboat. It is commonly done for mainsails by bunching up the portion of the sail adjacent to foot of the sail. In the case of headsails, although bunching up the foot of the sail with reef points is sometimes provided for, various ways of reefing a roller furling headsail have been practiced, dealing with the difficulty of rolling up the sail in a roller-furler without undesirably changing the shape of the sail in various ways. Roller furling mainsails can also be reefed by rolling them up.

Zippers running along one side of a generally triangular sail have been used in the past for introducing a bagginess at the foot of a mainsail which is held with its lower edge attached along a boom and, more recently, zippers running vertically have been used for furling the mainsail and also for furling a headsail, but without any possibility of reefing by partial furling. Examples of vertical zippers running near and parallel to the luff of a headsail or a mainsail for furling the sail entirely within an elongated bag or pocket are disclosed in U.S. Pat. Nos. 4,343,257 and 4,365.572.

SUMMARY OF THE INVENTION

It is an object of the present invention to provide a method of reefing a working sail of a sailboat, and particularly a mainsail, in a manner which shortens the foot of the sail, does not impair the shape of the sail as an airfoil and preserves a favorably high aspect ratio for this sail. In the case of a mainsail one object of the invention is to provide a first reefing stage providing a high efficiency sail so long as the wind permits the use of the full height of the mast, while permitting further reefing of the so-called jiffy or slab reefing kinds when further shortening of sail is desirable.

Briefly, a pair of talon fasteners of the kind known as zippers, each consisting of a pair of fastener tapes sewed to the sail and a fastener slide for progressively fastening the tapes together, are provided, one on each side of the sail. The first fastener has one tape extending from the head of the sail, close to the aft end of the headboard, substantially parallel to the luff of the sail all the way to the tack at the foot of the sail.

This first or "forward" fastener has another tape that likewise starts from the head of the sail, where it is normally joined by the fastener slide when full sail is in use. The fastener is prevented, in the usual way, from opening at the top when the slide is pulled up as far as it will go. This second fastener tape runs from the highest position of the slide down to a location along on the foot of the sail which is spaced from the tack by a fraction of the length of the foot, usually somewhere between 15% and 40% of the foot length, preferably from 25% to 35%.

The second or "aft" fastener runs on the other side of the sail from the first fastener. From the head of the sail its forward tape runs to a point of the foot of the sail that is about midway between the ends of the tapes of the first fastener, or just a little forward of that midpoint The aft tape of the second fastener extends from the head of the sail to a point on the foot of the sail aft from the end of the second tape of the first fastener by about the same distance that the latter lies aft of the first tape of the second fastener when the sail is fully spread out. Thus the bottom ends of the tapes of the two fasteners are interleaved along the foot of the sail in addition to being on opposite sides of the sail.

Both fasteners are controlled for putting in a reef by pulling on a line that extends from the fastener slide, which is normally at the head of the sail, down to a suitable place at the foot of the sail. There it can connect with another line used for "shaking out" a reef, which goes up the luff of the sail, over a sheave mounted on or near the headboard and then down to a connection to the fastener slide.

The terms "forward" and "aft", as will be evident from the drawings, refer to the position of the sail when it is ready to be reefed, so that "aft", for example, means towards the clew.

The invention takes advantage of the fact that when an angular sail segment having its apex at the top of the sail is removed from the sail area by closing a zipper from the top down, the portion of the sail not to be used, instead of being bunched up as in the usual horizontal reef, tends to be blown back in a simple fold in the new reefing operation, so that it can easily be zipped tight to an appropriate part of the portion of the sail that remains in use, for thereafter lying folded flat against a working part of the sail.

In addition to releasing the clew of the sail for the zip-reefing, it may be necessary in some cases, perhaps on large boats, to assist the zipper closure by pulling a D-ring at the bottom of the aft tape of the forward zipper fastener towards the tack of the sail, but the fastening of the aft zipper on the other side of the sail requires no such assistance to pulling down the fastener slide. The D-ring is in any event desirable for securing to the tack when the sail is reefed so that the outhaul can be safely pulled tight after the sail is reefed.

There is also disclosed herein an alternate way of providing a reef with a vertical zipper on each side of the sail which requires a sail of double luff construction. In this case the fastener tapes for the two fasteners on opposite sides of the sail are not interleaved as in the reefing system outlined above, but are at similar locations on opposite sides of the sail and enclose the unused part of the reefed sail within a pocket along the luff of the sail. There is no easy way in this last-mentioned system, however, to control the way the unused part of the sail folds up in the pocket. The first mentioned system of reefing is preferred because the system assures a clear run for the zippers and also avoidance of local bunching or random folding the unused part of the reefed sail.

Since both of the reefing systems disclosed herein remove from the effective sail area a triangular portion of the sail having its apex at the head of the sail, and since the foot of the sail and the boom which holds the sail out normally run horizontally, the forward portion of the reefed sail that is brought close to the tack by an operation of the forward zipper would generally end up at some distance below the tack of the sail, so that the D-ring which should be eventually secured to the tack to prevent the zipper from being strained by the outhaul should be located at a corresponding distance above the foot of the sail. The completion of the reef by closing the second or aft zipper will bring the clew of the sail below the normal position of the boom. It is preferable to provide an auxilliary clew cringle above the full-sail clew for fastening to the outhaul car, rather than merely to lower the boom with the topping lift in order use the full-sail clew without unfastening it from the outhaul car of the boom.

BRIEF DESCRIPTION OF THE DRAWINGS

The invention is further by way of illustrative example with reference to the annexed drawings, in which.

Figure 1:
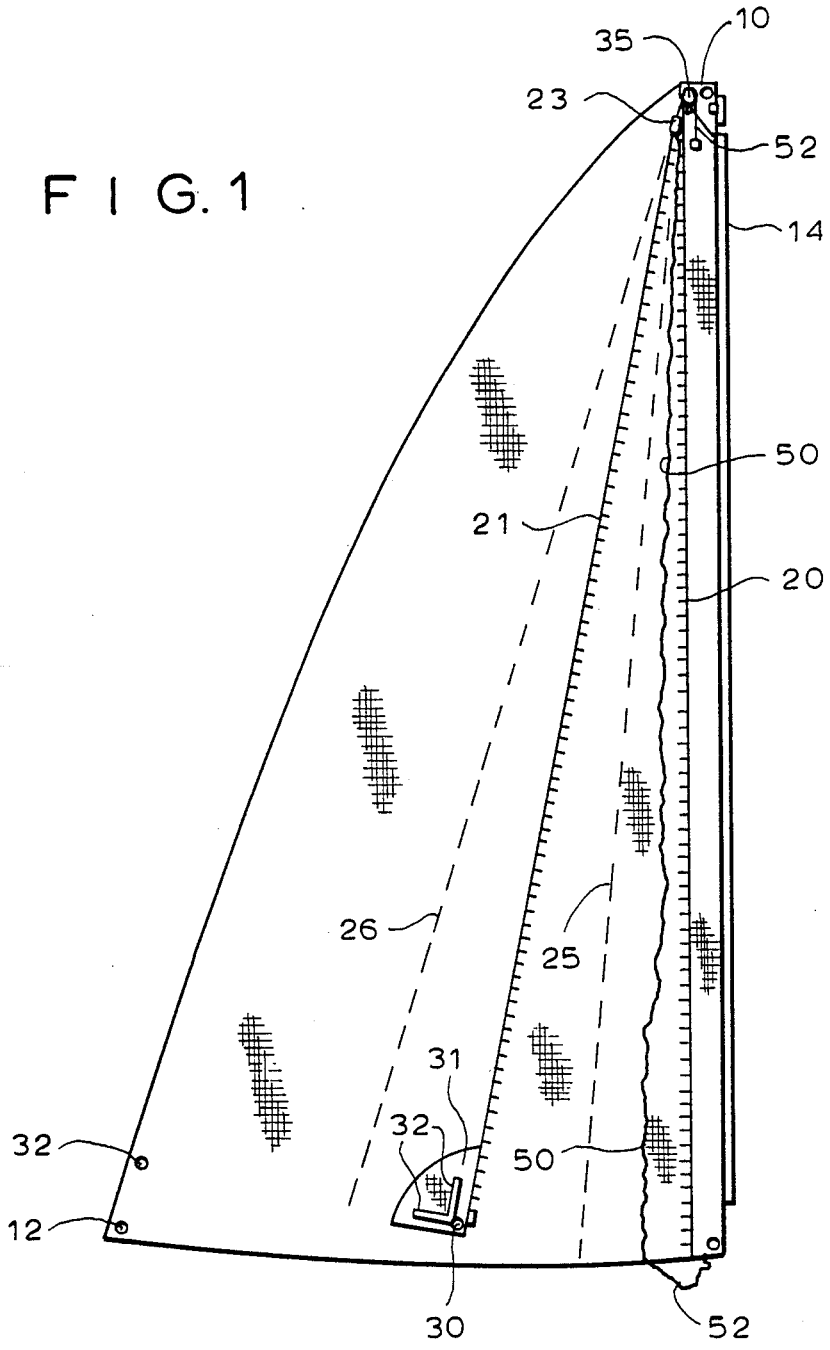
FIG. 1 is a side view of a mainsail for a sailboat embodying the invention, seen from the forward zip-fastener side.

DESCRIPTION OF THE ILLUSTRATED EMBODIMENTS:

FIG. 1 shows a mainsail of a sailboat as it might appear when spread out on a sail loft floor. It has a headboard 10 at the head of the sail and cringles 11 and 12 respectively at the tack and the clew. The luff of the sail is provided with a bead 14 (for holding the sail in a mast slot) running from just above the tack to the bottom of the headboard, which is not visible in FIG. 1 because of the scale of the drawing. The foot of the sail from the tack to the clew is loose, which is to say it is not designed to be held by sliders or a bead in a boom, since this sail is designed to be vertically reefed. The clew cringle 12, however, is designed to be attached to an outhaul car slidable on a boom, so that the sail will be trimmed by a boom in the usual way. The sail is equipped with a forward vertical zip-fastener composed of the tapes 20 and 21 and the fastener slide 23.

Figure 2:
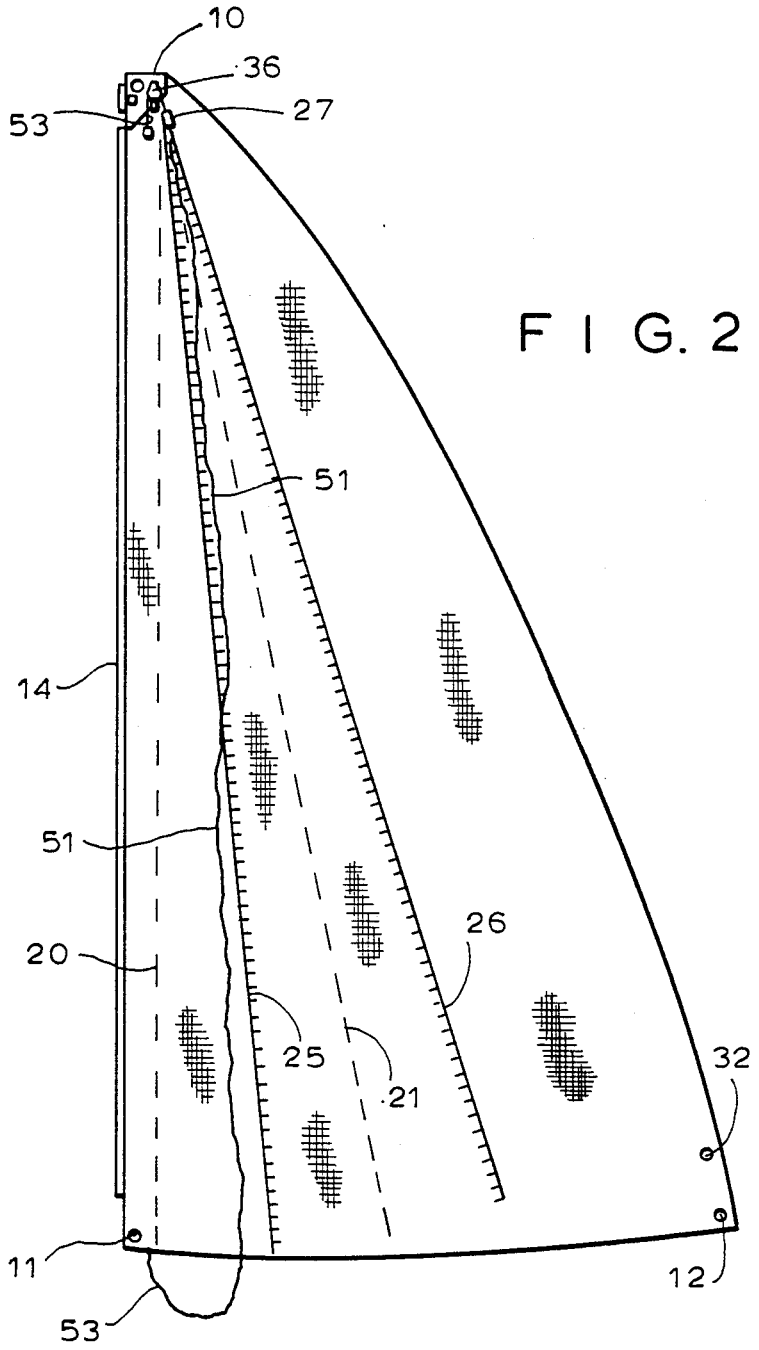
FIG. 2 is a view of the other side of the mainsail shown in FIG. 1.

FIG. 2 shows the other side of the sail of FIG. 1. On this side there is shown, in the same schematic way used in FIG. 1, the aft zip-fastener which is composed of the fastener tapes 25 and 26 and the fastener slide 27. The forward tapes 20 and 25 respectively of the forward and aft zip-fasteners extend all the way to the foot of the sail, but the corresponding aft tapes 21 and 26 are shown as extending just short of the foot of the sail, since it is not necessary to make them any longer than the mating fastener tape to which the aft tape is fastenable.

At the foot of the tape 21 in FIG. 1 there is a D-ring 30 held to the sail by woven tapes 29 (FIG. 6) sewed to a reinforcement patch 31, so that the bottom end of the tape 21 can be pulled towards the tack cringle 11 if horizontal force is needed to assist the closing of the zip-fastener.

An auxillary clew cringle 32 is provided for connection to the outhaul in the reefed condition of the sail in order to prevent the boom from drooping below its normal position.

The opening and closing of the zip-fasteners by moving the respective fastener slides 23 and 27 is performed by means of lines accessible at the sail foot.

The reefing lines 50 and 51 for pulling down the fastener slides 23 and 27 extend to a suitable place on the boom, not shown, and are usually loose. The unreefing lines 52 & 53 run from the respective fastening sliders over a small sheave shown at 35 in FIG. 1 and 36 in FIG. 2 and then run down along the luff of the sail, preferably within space enclosed by a strip of cloth that runs along the fastener tapes 20 (FIG. 5) and 25 (or along the luff instead of along the tape 25). Preferably the reefing and unreefing lines are connected together to make to an endless loop at the foot of the sail.

In reefing, right after the outhaul connected to the clew cringle 12 is released and connected to the cringle 32, the slide 23 is first gradually pulled down to the foot of the sail until the fastening tapes 20 and 21 are joined over their whole length.

At this time a clip or a line should be used to connect the D-ring 30 to the cringle 11 to secure the reef unless the zip fastener is equipped with a lock for its closed position. Then the slide 27 on the other side of the sail is similarly pulled down until the fastener tapes 25 and 26 are joined along their whole length. The outhaul can be tightened as soon as the forward zip fastener is locked shut by use of the D-ring 30 or otherwise. In practice one person can start closing the aft zip-fastener as soon as another person has closed the forward zip-fastener part way and the first person can tighten the outhaul before the aft zip-fastener is fully closed.

Figure 3:
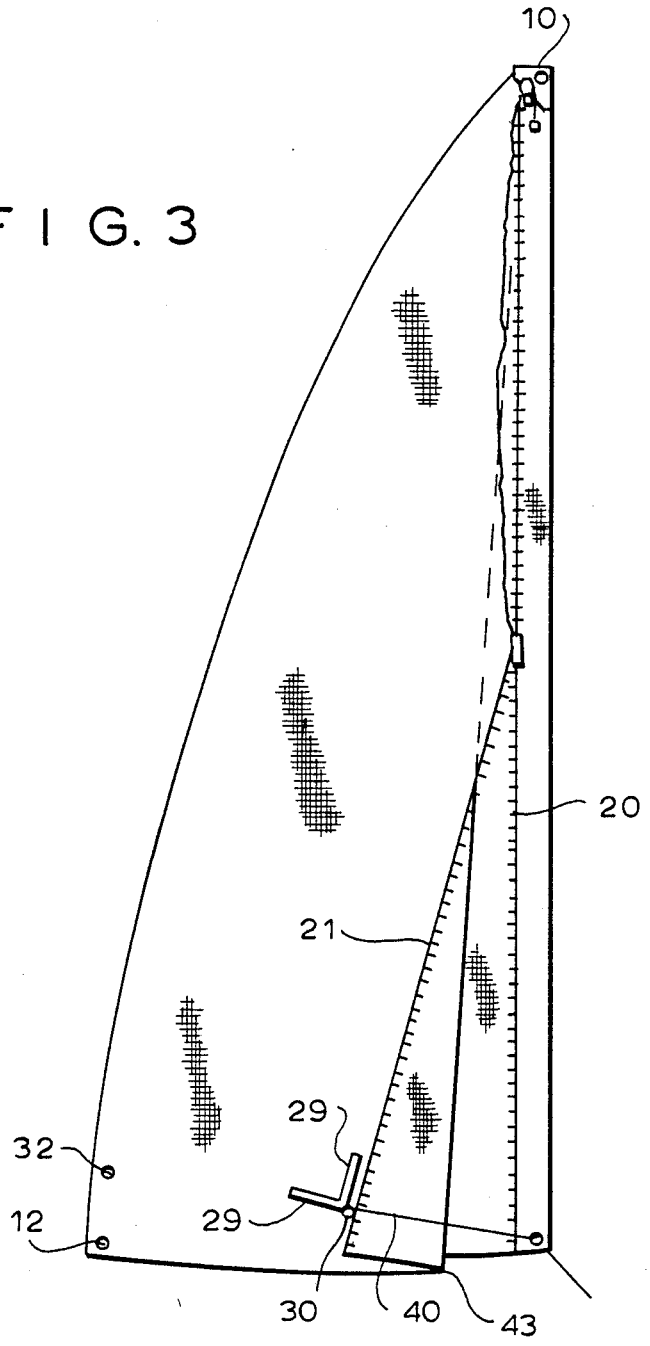
FIG. 3 is a view of the sail of FIG. 1, as seen from the same side as in FIG. 1, after the forward zip-fastener has been partially closed.

FIG. 3 shows the sail of FIG. 1 with the fastener tapes 20 and 21 partially closed and a line 40 connecting the D-ring 30 and the cringle 11 to pull the D-ring 30 towards the cringle 11 and thereby assist the pulling down of the fastener slide 23. As already mentioned, the use of such a line 40 is usually not necessary. At the stage shown in FIG. 3 the forward part of the sail tends to fold as shown at 42 and 43.

Figure 4:
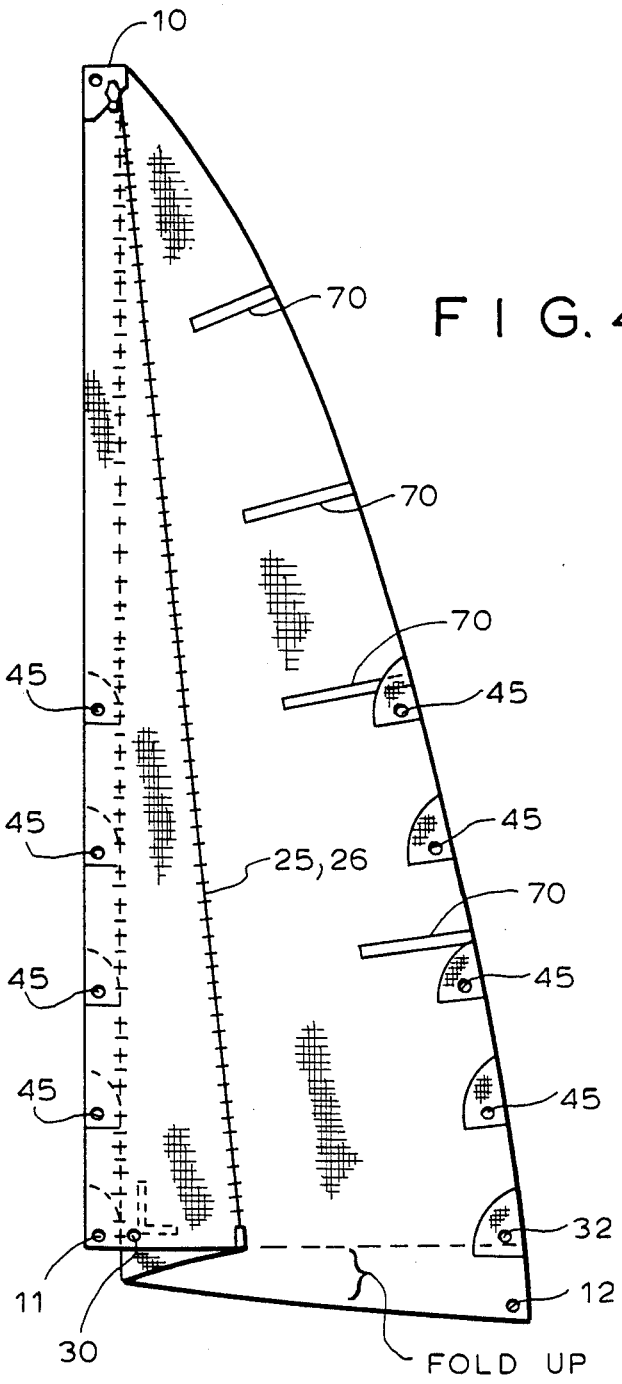
FIG. 4 is a view of the sail of FIG. 1 after both zip-fasteners are fully closed, seen from the same side as FIG. 1

In FIG. 4 the sail is shown completely zip-reefed. No boom is shown in the drawing. Since the cringle 32 is connected to the outhaul and the D-ring 30 is connected to the tack cringle 11, it may be convenient to fold up the portion of the sail drooping below the D-ring 30 and the cringle 32. Since this is only a small portion of the sail, this may be done neatly with pressure-fastening patches (not shown) available under the trademark Velcro®.

FIG. 4 also shows cringles for four horizontal reefs of the usual type that may be used for further reduction of the sail area. Reef points, not shown, would also be used for the horizontal reefs. The cringles 45 for regular horizontal reefing known as "jiffy" or "slab" reefing are situated for use after the vertical reef has first been put in place. If it were desired to provide for horizontal reefing without first taking in the vertical reef, it would be necessary to provide additional cringles at the luff or at the leech, or perhaps both. Additional reef points would then also be required.

The sail of FIGS. 1–4 has conventional battens 70. It may be convenient to provide an additional batten, not shown, for running along the top of the boom when the sail is zip-reefed. It could also be useful to provide some sliders on the boom and a few reef points (not shown)

for the zip-reefed condition for optionally either flattening the sail at its foot or else merely bunching the sail material tending to hang below the top of the boom, without flattening the sail.

In sailing a race around a twice-around course, the zip-reef can be pulled out for a leeward course leg without changing the outhaul cringle connection, so as to permit more rapid zip-reefing at a down-wind mark for the next windward leg.

The zip-fasteners 120–123 and 125–127 are preferably heavy duty coil chain zippers which are commercially available attached to webbing suitable for sewing to cruising or racing sails, in long lengths that can be cut to size and fitted in a sail loft with permanent stops and, if desired, locks for openable ends.

Figure 5:
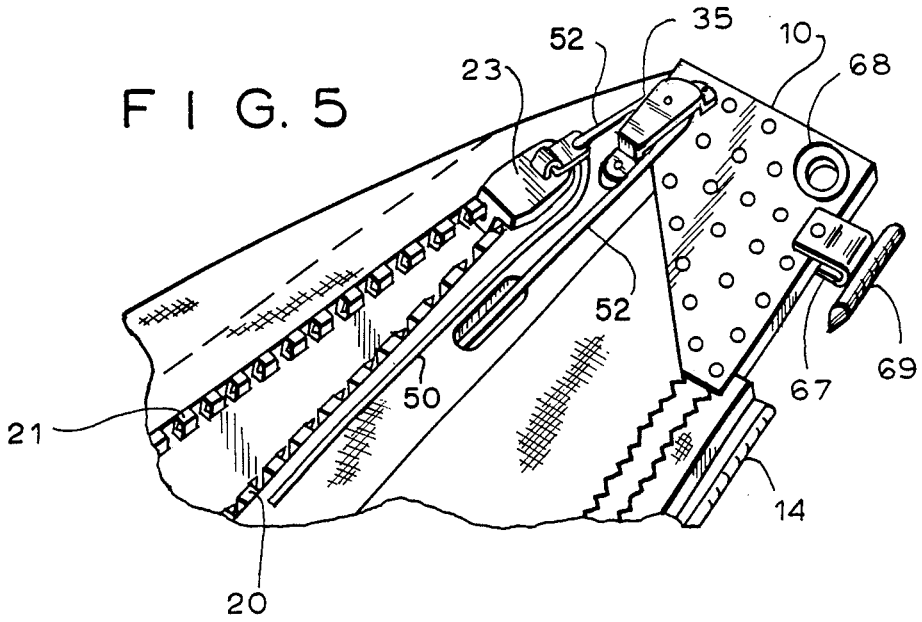
FIG. 5 is a detail view of the head of the sail of FIG. 1.

FIG. 5 is a detailed view of the head of the sail, showing the side illustrated in FIG. 1 and FIG. 3. The mounting of the sheave 35 partly on the headboard 10 and the partly on the reinforced portion of the sailcloth adjoining the headboard is shown in FIG. 5, likewise the slide fastener 23 and its connections to the lines 50 and 51. The cringle 68 is of course for attachment of the halyard for hoisting the sail. In the particular sail illustrated in FIG. 5 the luff bead 14 does not extend appreciably beyond the bottom of the headboard 10 and a slug guide 69 for the headboard 10 is fastened to the headboard 10 with webbing 67.

Figure 6:
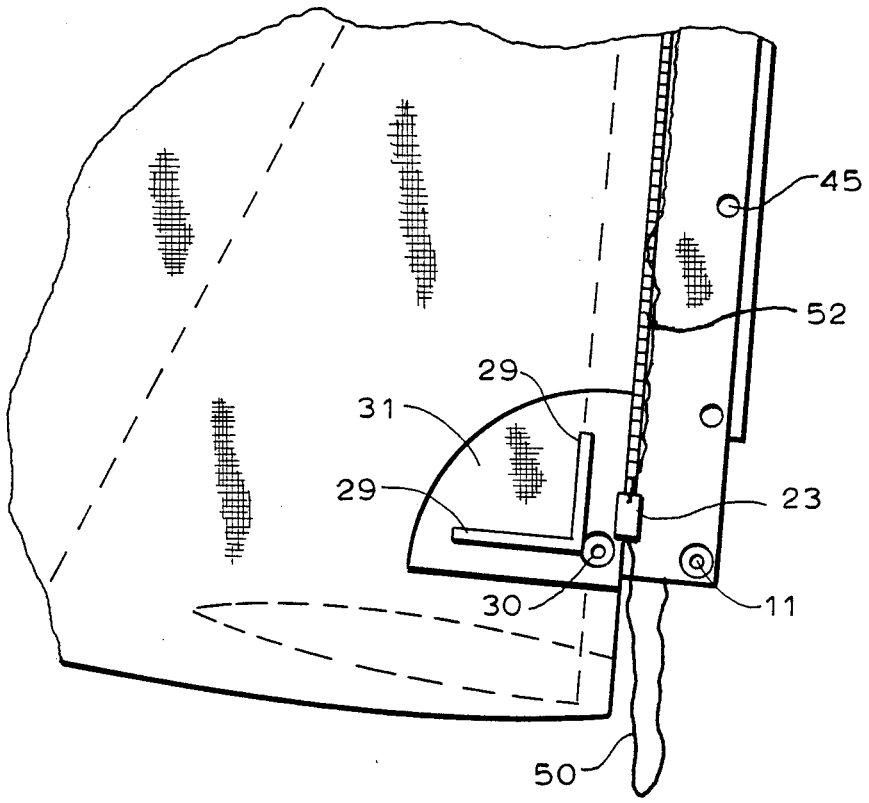
FIG. 6 is a detail view of the tack of the sail of FIG. 1 from the side shown in FIG. 1.

FIG. 6 is a detailed view of the tack of the sail, again seen on the side shown in FIGS. 1 and 3. This view shows more clearly the D-ring 30, the tapes 29 holding the D-ring place and the reinforcing patch 31 at the part of the sail to which the webbing tapes 29 are stitched. The fastening slide 23 is located at almost the bottom of its run. It is not necessary for it to run all the way to the foot of the sail. In the view of FIG. 6 the sail is loose and the second zip-fastener has not yet been closed.

Figure 7:
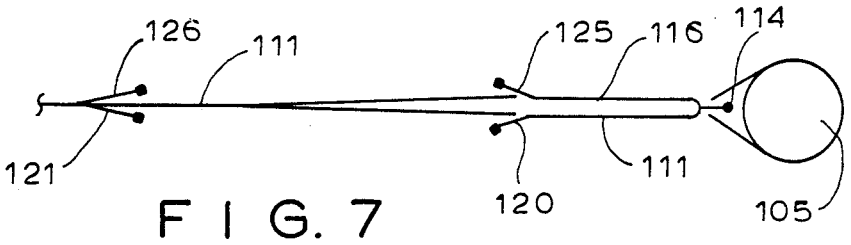
FIG. 7 is the cross-section of another embodiment of a vertically zip-reefed mainsail, utilizing a double-luff sail, in the full sail condition.
Figure 8:
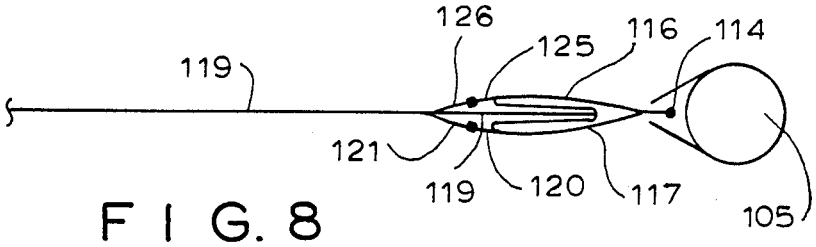
FIG. 8 is a schematic cross-section of the sail of FIG. 7 in the zip-reefed condition.

Another embodiment of vertically zip-reefing mainsail is shown in FIGS. 7 and 8. FIGS. 7 and 8 are schematic cross-sections of a double-luffed sail version of the invention in which the zip fasteners are similarly located on opposite sides of the sail. The sail is shown engaged in a mast section having a slot into which the luff bead or slug sliders 114 fit. FIG. 7 shows the unreefed position. The double-luffed portion of the sail has a luff portion 116 and a luff portion 117 which are joined together at the luff and at 118 where they connect with a single web sail portion 119. The zip-fastener on the side of the sail which is the bottom side in the FIG. 7 profile drawing has a fastener tape 120 and a fastener tape 121, respectively sewed to the luff portion 117 and the aft sail portion 119, while the second zip fastener on the other side of the sail has a tape 125 sewed to the luff portion 116 and a fastener tape 126 sewed to the after portion 119 of the sail. The fastener tapes 120 and 121 meet at the top of sail adjacent to the headboard (not shown) and the same is true of the fastener tapes 125 and 126 on the other side of the sail. The fastener tapes of each fastener diverge at the same angle towards the foot of the sail, the tapes 120 and 125 running substantially parallel to the luff bead 14.

FIG. 8 shows the sail of FIG. 7 with both zip-fasteners closed. In this case, as in the case of the embodiments shown in FIGS. 1–4, a triangular segment of the sail having its apex at the head of the sail is removed from the effective sail area, but in this case the portion of the sail removed from the effective sail area for accomplishing the reef is bunched in the pocket formed between the double-luff members 116 and 117. The reefing and unreefing lines are run in substantially the same way, utilizing a sheave on each side of the headboard, as in the embodiment of FIGS. 1–6.

Since in this case, just as in the embodiment of FIGS. 1-6, reefing a triangular segment of the sail with its apex at the head of the sail causes the clew to droop, the matter of avoiding the drooping of the boom is handled in the same way as shown in FIGS. 1–4. This is illustrated in FIG. 9 and in view of the description in FIGS. 1–4, little further description is necessary for FIG. 9.

Figure 9:
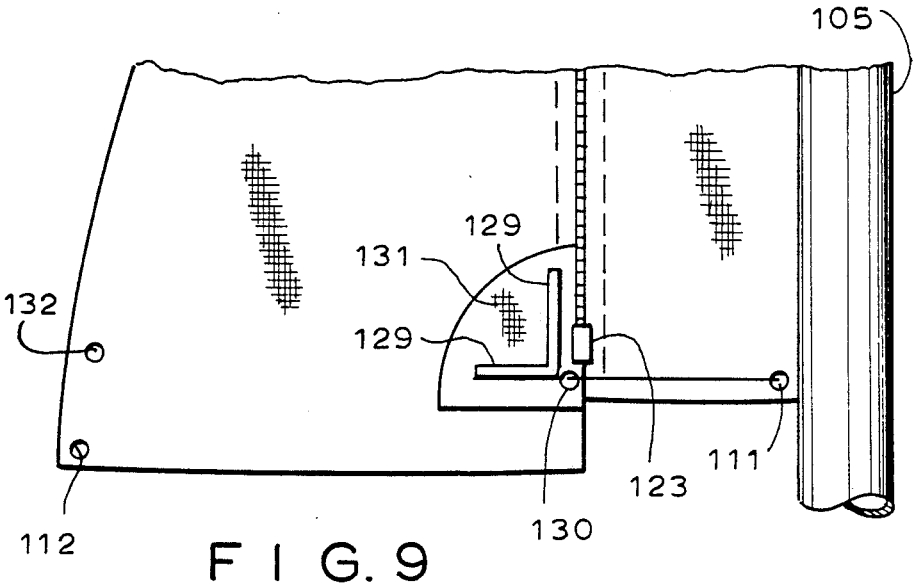
FIG. 9 is a side view of the lower part of the sail of FIG. 8.

In FIG. 9 the tack cringle is shown at 111, the full sail clew cringle at 112, the zip-reefing clew cringle at 132, the D-ring corresponding to the D-ring 30 of FIG. 1 and FIG. 6 at 130, its webbing tapes at 129 and the reinforcing patch where these tapes are sewed to the sail at 131. One of the zip-fastener slides appears at 123. A portion of the mast is shown at 105, with the luff bead of the sail in its slot as shown in FIGS. 7 and 8.

Reefing according to the invention keeps the aspect ratio of the sail high and actual raises that ratio.

Although the invention has been described with reference to particular illustrative examples, it will be understood that variations and modifications are possible within the inventive concept.

We claim:

1. A vertically zip-reefable working sail for a sailboat, said sail having a head, a tack and a clew, a luff extending from the head to the tack, a leech extending from the head to the clew and a foot extending from the tack to the clew, and further comprising:

a first zip-fastener on a first side of the sail having a fastener slide and a forward fastener tape extending from the head of the sail to the foot on a course which is close to and at a substantially constant spacing from the luff of the sail and an aft fastener tape extending from the head of the sail towards a first location on the foot of the sail which is spaced from the foot end of said forward fastener tape by between 15% and 40% of the length of the foot of the sail, said aft fastener tape extending towards said location on the foot of the sail for a distance not substantially less than the length of said forward tape;

a second zip-fastener on the second side of the sail having a fastener slide and forward fastener tape extending from the head of the sail to a second location at the foot of the sail which is approximately mid-way, or slightly closer to the luff than mid-way, between the foot end of said forward fastener tape of said first zip-fastener and said first location on the foot of the sail and an aft fastener tape extending from the head of the sail towards the foot of the sail for a distance not substantially less than the length of said forward tape of said second zip fastener to a point which, when both zip fasteners are open and the sail is spread out, is spaced from the aft tape of said first zip fastener by about the same distance as the spacing between said forward tape of said second zip fastener and said aft tape of said first zip fastener;

reefing lines respectively extending down from said fastener slides to the region of the foot of the sail;

line redirecting means at each side of the head of the sail, and unreefing lines respectively extending up from said slide fasteners to said respective redirecting means and thence down to the region of the foot of the sail.

2. A vertically zip-reefable working sail for a sailboat, said sail having a head, a tack and a clew, a luff extending from the head to the tack, a leech extending from the head to the clew and a foot extending from the tack to the clew, and further comprising:

a first zip-fastener on a first side of the sail having a fastener slide and a forward fastener tape extending from the head of the sail to the foot on a course which is close to and at a substantially constant spacing from the luff of the sail and an aft fastener tape extending from the head of the sail towards a first location on the foot of the sail which is spaced from the foot end of said forward fastener tape by between 15% and 40% of the length of the foot of the sail, said aft fastener tape extending towards said first location on the foot of the sail for a distance not substantially less than the length of said forward tape;

a second zip-fastener on the second side of the sail having a fastener slide and forward fastener tape extending from the head of the sail to a second location at the foot of the sail which is approximately mid-way, or slightly closer to the luff than mid-way, between the foot end of said forward fastener tape of said first zip-fastener and said first location on the foot of the sail and an aft fastener extending from the head of the sail towards the foot of the sail for a distance not substantially less than the length of said forward tape of said second zip fastener to a point farther aft than said second location;

reefing lines respectively extending down from said fastener slides to the region of the foot of the sail;

line redirecting means at each side of the head of the sail;

unreefing lines respectively extending up from said slide fasteners to said respective redirecting means and thence down to the region of the foot of the sail, and wherein means are provided for securing a portion of the sail adjacent to the end of said aft fastener tape of said first zip fastener near said first location on the foot of the sail to the portion of the sail adjacent to the tack thereof independently of the fastener slide of said first zip fastener, and wherein a cringle is provided on the leech of the sail above the clew of the sail for connection to an outhaul car of a boom when the sail is in its zip-reefed condition.

3. A sail according to claim 2, wherein said securing means include a D-ring sewed with tapes to the sail on the portion of the sail just aft of said aft tape of said first zip-fastener at the lower end thereof.

4. A vertically zip-reefable sail for a sailboat, said sail having a head, a tack and a clew, a luff extending from the head to the tack, a leech extending from the head to the clew and a foot extending from the tack to the clew, and further comprising:

a pair of zip-fasteners each having a pair of fastener tapes and a fastener slide and extending from the head of the sail to the foot and disposed so that when the slides of both fasteners are drawn to the sail foot a triangular area of the sail having its apex at the sail head is removed from the effective area of the sail by folding while the closed fasteners provide a smooth sail surface on both sides of the sail in each case made up of two portions joined by a fastener extending substantially from sail head to sail foot;

reefing lines respectively extending down from said fastener slides to the region of the foot of the sail;

line redirecting means at each side of the head of the sail;

unreefing lines respectively extending up form said slide fasteners to said respective redirecting means and thence down to the region of the foot of the sail;

wherein the head of the sail is provided with a headboard and wherein a portion of the sail narrower than said headboard at the top, and having a width at the foot of the sail over three times the width at the top and not greater than 40% of the length of the foot of the sail is of double-luff construction, while the remainder of the sail is of single-web construction, and wherein said pair of zip-fasteners consist of first and second zip-fasteners unopenable at the top, extending from just under the headboard to a location centered on the boundary between said double-luff portion of the sail and the remainder of the sail and having a forward fastener tape extending to a location at the foot of the double-luff portion of the sail about mid-way between the luff and the boundary at the foot between the double-luffed portion of the sail and the remainder of the sail, or a point slightly aft of mid-way therebetween, the foot ends of said forward tapes of said respective zip-fasteners having the same spacing from the luff of the sail, the aft fastener tapes of said respective zip-fasteners running from their top near the headboard in a direction making them equidistant with said forward fastener tapes to said boundary between the double-luffed portion of the sail and the remainder portion of the sail and extending towards the foot of the sail for a distance at least about as long as the length of said forward fastener tapes, and wherein means are provided for securing a portion of the sail adjacent to the aft tape of each of said zip-fasteners to the portion or portions of the sail forward of the foot of the forward tapes of said fasteners independently of the fastener slides of said fasteners.

5. A sail as defined in claim 4, wherein said securing means includes at least one D-ring sewed to the sail by means of tapes in a location adjacent to the foot and of said aft tapes of said respective zip-fasteners.

* * * * *